US010577175B2

(12) United States Patent
Rogers et al.

(10) Patent No.: US 10,577,175 B2
(45) Date of Patent: Mar. 3, 2020

(54) METHOD AND APPARATUS FOR SHIPPING AND STORAGE OF CRYOGENIC DEVICES

(71) Applicant: KONINKLIJKE PHILIPS N.V., Eindhoven (NL)

(72) Inventors: John Rogers, Burnt Hills, NY (US); Eduardus Maria Bek, Veghel (NL)

(73) Assignee: Koninklijke Philips N.V., Eindhoven (NL)

( * ) Notice: Subject to any disclaimer, the term of this patent is extended or adjusted under 35 U.S.C. 154(b) by 490 days.

(21) Appl. No.: 15/057,185

(22) Filed: Mar. 1, 2016

(65) Prior Publication Data

US 2016/0176628 A1 Jun. 23, 2016

Related U.S. Application Data

(63) Continuation of application No. 13/641,887, filed as application No. PCT/IB2011/051888 on Apr. 28, 2011, now abandoned.

(Continued)

(51) Int. Cl.
*F17C 3/08* (2006.01)
*B65D 88/74* (2006.01)

(Continued)

(52) U.S. Cl.
CPC ..... *B65D 88/741* (2013.01); *B65D 88/121* (2013.01); *B65D 88/125* (2013.01);

(Continued)

(58) Field of Classification Search
CPC ..... F17C 2270/0527–0536; F17C 2270/0168–0178; F17C 13/086–087;

(Continued)

(56) References Cited

U.S. PATENT DOCUMENTS 3,044,653 A 7/1962 Tantlinger
3,638,443 A 2/1972 Maurer (Continued)

FOREIGN PATENT DOCUMENTS

DE 192994929168 11/2005
GB 2431981 A 5/2007

(Continued)

*Primary Examiner* — Eric S Ruppert

(57) ABSTRACT

An International Organization for Standardization (ISO) shipping container 10 includes a cryogenic refrigeration system 14 for cryogenically cooling superconducting magnet(s) $\mathbf{12}_A$, $\mathbf{12}_B$ during transit. The cryogenic refrigeration system 14 monitors the temperature and/or pressure of the superconducting magnet(s) and circulates a refrigerant to the superconducting magnet(s) to maintain cryogenic temperatures in superconducting coils. A power supply 16, provided by a transportation vehicle, connects to the cryogenic refrigeration system via a power inlet 20 which is accessible from the exterior of the shipping container. The superconducting magnet(s) are suspended within the shipping container which is then loaded onto the transportation vehicle. The external power supply is connected to the cryogenic refrigeration system such that refrigerant is circulated to a cold head $\mathbf{22}_A$, $\mathbf{22}_B$ of each superconducting magnet. Maintaining cryogenic temperatures during transit minimizes losses to any liquid cryogen or gaseous cryogen installed in the superconducting prior to transit.

16 Claims, 5 Drawing Sheets

Related U.S. Application Data

(60) Provisional application No. 61/330,937, filed on May 4, 2010.

(51) Int. Cl.

| | |
|---|---|
| ***B65D 88/12*** | (2006.01) |
| ***F25D 3/10*** | (2006.01) |
| ***F25D 19/00*** | (2006.01) |
| ***F25D 29/00*** | (2006.01) |
| ***B65D 90/02*** | (2019.01) |
| *F25D 16/00* | (2006.01) |

(52) U.S. Cl.
CPC ..... *B65D 90/02* (2013.01); *F17C 3/085* (2013.01); *F25D 3/105* (2013.01); *F25D 19/006* (2013.01); *F25D 29/001* (2013.01); *F17C 2270/0527* (2013.01); *F17C 2270/0536* (2013.01); *F25D 16/00* (2013.01); *Y10T 29/49014* (2015.01); *Y10T 29/49359* (2015.01)

(58) Field of Classification Search
CPC ..... F17C 3/085; F17C 2250/0439; F17C 2250/043
See application file for complete search history.

(56) References Cited

U.S. PATENT DOCUMENTS

| | | | |
|---|---|---|---|
| 3,692,100 | A | 9/1972 | Gallagher, Jr. |
| 3,919,852 | A | 11/1975 | Jones |
| 5,150,578 | A | 9/1992 | Oota et al. |
| 5,385,010 | A | 1/1995 | Horn |
| 5,469,711 | A | 11/1995 | McCoy |
| 5,913,888 | A | 6/1999 | Steinmeyer et al. |
| 6,148,629 | A | 11/2000 | Boxum |
| 7,018,249 | B2 | 3/2006 | Ries |
| 7,540,159 | B2 | 6/2009 | Chan |
| 2003/0024252 | A1 | 2/2003 | Funayama et al. |
| 2005/0109042 | A1 | 5/2005 | Symko |
| 2006/0042275 | A1 | 3/2006 | Tanaka |
| 2007/0051116 | A1 | 3/2007 | Glemont et al. |
| 2007/0120631 | A1 | 5/2007 | Hobbs et al. |
| 2008/0209919 | A1 | 9/2008 | Ackermann et al. |
| 2009/0266100 | A1 | 10/2009 | Viegas |
| 2010/0016168 | A1 | 1/2010 | Atkins et al. |

FOREIGN PATENT DOCUMENTS

| | | | |
|---|---|---|---|
| JP | 035525 | U | 1/1991 |
| JP | 0484193 | A | 3/1992 |
| JP | 2000258016 | A | 9/2000 |
| JP | 2003202163 | | 7/2003 |
| JP | 4034816 | B1 | 1/2008 |
| WO | 2007052069 | A1 | 5/2007 |

METHOD AND APPARATUS FOR SHIPPING AND STORAGE OF CRYOGENIC DEVICES

This application is a continuation/divisional of U.S. application Ser. No. 13/641,887, filed Oct. 18, 2012, which is US National Stage Entry of PCT Application No. PCT/IB2011/051888, with an International Filing Date of Apr. 28, 2011, and claims the priority of U.S. Application Ser. No. 61/330,937, Filed May 4, 2010.

DESCRIPTION

The present application relates to the magnetic resonance imaging arts. It finds particular application to the storage and transportation of cryogenically cooled main magnet assemblies used in magnetic resonance imaging systems. However, it also finds application in magnetic resonance spectroscopy and other nuclear magnetic resonance techniques along with other systems with cryogenically cooled components.

Magnetic resonance imaging (MRI) systems typically include a superconducting magnet which is cooled to a superconducting operating temperature. Superconductivity occurs in certain materials at very low temperatures where the material exhibits an electrical resistance of approximately zero and exhibits no interior magnetic field. The superconducting state reduces the electrical load required to maintain a desired magnetic field strength. The superconducting operating temperature or critical temperature depends at least on the type of superconductor material, the current density, and the magnetic field strength. In low temperature systems, a niobium-titanium (NbTi) superconducting magnet has a transition temperature of approximately 10K and can operate at up to 15 Tesla, while a more expensive niobium-tin ($Nb_3Sn$) superconducting magnet has a transition temperature of approximately 18K but can operate up to 30 Tesla. Higher temperature superconducting magnets, such as iron or copper based alloys, transition to superconductivity at temperatures that range from 10-100K.

In conventional low temperature systems, such as niobium based magnets, the magnetic coil windings are suspended in a vacuum annulus or cryostat that is partially filled with a liquid cryogen, such as helium. The coil windings are partially immersed in the helium bath and cooled to below the superconductive state. Liquid helium boils at 4.2K at standard atmospheric conditions. During normal operation, heating from the external environment and the gradient coils can cause boil off of the liquid helium and cryostat pressure to rise. To minimize the amount of helium boil off, a cryogenic refrigeration system is used to cool one or more conductive thermal shields to temperatures between 10K and 100K. These shields intercept heat from the environment and reduce the amount of heat reaching the coil windings while the refrigeration system cools the thermal shields by actively circulating a refrigerant. In some systems the cryogenic refrigeration systems is capable of attaining temperatures low enough to re-condense the gaseous helium to a liquid state. The recondensed liquid helium collects in the existing liquid helium bath.

In higher temperature systems, cryogens with higher boiling points, such as hydrogen, neon, nitrogen, or the like, are used to bathe the superconducting coils and/or used as the refrigerant to cool a cold head which is thermally coupled to the heat shields.

In a cryogen-free superconducting magnet, the superconducting coils are conductively coupled to cooling tubes or solid thermal conductors such as flexible copper straps. This arrangement eliminates the need for a liquid cryogen filled cryostat and prevents the large outflow of cryogen gas out of the cryostat if the magnet quenches, i.e. loses superconductivity. The cryogenic refrigeration system cools a cold head which is thermally coupled to the solid thermal conductors or to a small cryogen reservoir which supplies the cooling tubes to keep the superconducting coils in a superconductive state. In either design, both the cryostat and the thermal conductors are surrounded by a thermal shield to prevent heating from external infrared radiation and then encompassed by a vacuum chamber to inhibit heating from internal convection of the cryogen.

After a superconducting magnet is manufactured, the cryostat is cooled, typically by filling with a liquid cryogen, and tested at the manufacturing facility to ensure normal operation before it is shipped to its final destination, e.g. a hospital, clinic, lab, research facility, etc. Depending on the size of a cryogenically cooled superconducting magnet, the cryostat can typically hold anywhere from 1000 liters to almost 2000 liters of liquid cryogen. It is common for the manufacturer to install the cryogen before shipping the superconducting magnet to the customers to avoid the expense of cooling the magnet to operating temperature a second time. Manufacturers attempt to ship the superconducting magnet along with the cryogenic refrigeration system to customer as quickly as possible to reduce the cryogen losses during transport. Since the cryogenic refrigeration system is not active during transport, the temperature of the thermal shields rises and the heat transferred to the coil windings increases dramatically. In low temperature systems, a release valve as part of the cryostat may vent more than 75% of the installed helium during transport to relieve the increased pressure due to helium boil off. Exhausting the excess pressure ensures the cryostat's and vacuum chamber's integrity. This cost is transferred to the customer at a rate ranging from $5,000 to $10,000 USD to replace the exhausted cryogen. Having to replace the lost cryogen is problematic in many areas of the world where the supply of replacement liquid cryogen is not readily available. Therefore, a transportation system which reduces cryogen losses during transport while using existing infrastructures would be desirable for both manufacturers and customers of superconducting magnets.

The present application provides a new and improved system and method for transportation and/or storage of cryogenically cooled devices which overcomes the above-referenced problems and others.

In accordance with one aspect, a shipping container for transporting at least one cryogenically cooled device on a transportation vehicle is presented. A cryogenic refrigeration system monitors the temperature and/or pressure of the cryogenically cooled device and circulates a refrigerant to the cryogenically cooled device to maintain cryogenic temperatures. A power inlet, accessible from an exterior of the shipping container, connects power from an external power supply that is provided by the transportation vehicle to the cryogenic refrigeration system.

In accordance with another aspect, a method for transporting at least one cryogenically cooled device in a shipping container is presented. The cryogenically cooled device is secured within the shipping container and then the shipping container, with the cryogenically cooled device, is loaded onto a transportation vehicle. A power inlet of the cryogenic refrigeration system is connected to an external power supply provided by the transportation vehicle. The transportation vehicle then transports the shipping container to a destination.

In accordance with another aspect, a method of manufacturing a shipping container for transporting a cryogenically cooled device is presented. The method includes integrating a refrigeration system which utilizes less than 15 kW into an International Organization for Standardization (ISO) intermodal container. The ISO intermodal container is modified to accommodate external access to a power source connection and a display unit of the refrigeration system. The ISO intermodal container is also modified to accommodate external access to an air exhaust vent of the integrated refrigeration system.

One advantage is that the loss of installed cryogen is dramatically reduced during transit.

Another advantage is that existing power supplies can by utilized instead of an onboard generator.

Another advantage relies in that the cryogen cooled device may be stored indefinitely with little to no loss of installed cryogen.

Still further advantages of the present invention will be appreciated to those of ordinary skill in the art upon reading and understand the following detailed description.

The invention may take form in various components and arrangements of components, and in various steps and arrangements of steps. The drawings are only for purposes of illustrating the preferred embodiments and are not to be construed as limiting the invention.

Figure 1:
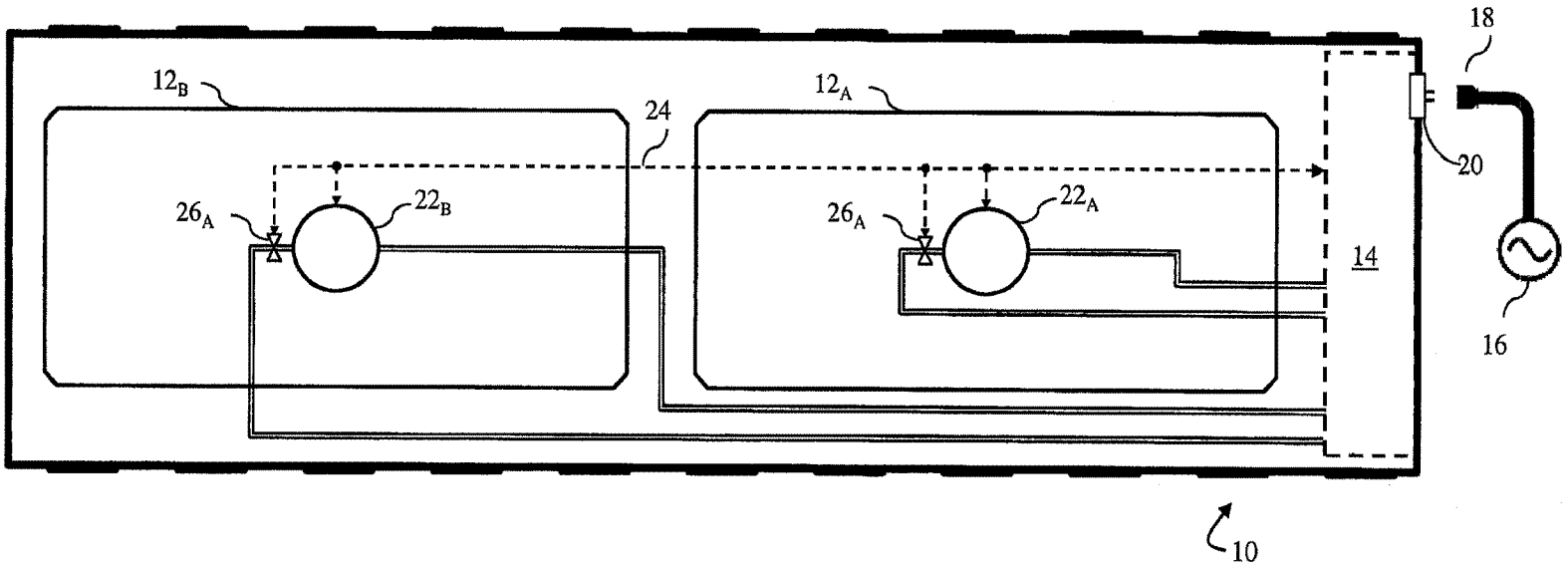
FIG. 1 is schematic top-view of a shipping container for transporting and storing cryogenically cooled devices.

With reference to FIG. 1, a schematic view of a shipping container 10 for the transportation and maintenance of cryogen cooled devices or payload is shown. The present embodiment is described with particular reference to transporting superconducting magnets $\mathbf{12}_A$, $\mathbf{12}_B$ for use in magnetic resonance imaging (MRI) or nuclear magnetic resonance (NMR) systems. It should be appreciated that other cryogenically cooled devices or payloads may also be transported using the shipping container 10, e.g. pharmaceuticals, living tissue, semiconductors, or the like.

The shipping container 10 is a standard intermodal container or ISO container as prescribed by the International Organization for Standardization (ISO) for use during intermodal freight transport. Typically, ISO containers are 8-foot wide and range in heights from the standard 8-foot to high cube units which measure 8-foot-6-inches, 9-foot-6-inches, or 10-foot-6-inches. The most common lengths include 20-foot and 40-foot although other lengths do exists. A typical container has doors fitted at one or both ends and is constructed of corrugated weathering steel. Open-top containers include the corrugated steel walls and doors while the roof includes removable bows which support a removable tarpaulin and contribute to the containers stability. Open-top containers facilitate easy loading and unloading from above. Flat-rack containers are open containers with collapsible end walls and a reinforced floor mainly used for shipping overweight, overheight, and overwidth cargoes, e.g. high-field open (HFO) or C-arm magnets. The containers can be transported by semi-trailer truck, freight trains, container ship, or airplane.

The shipping container 10 includes a self-contained cryogenic refrigeration system 14. The refrigeration system 14 relies on an existing power supply 16 via a plug 18 such as those supplied to refrigerated intermodal containers. Refrigerated intermodal containers are typically provided with 15 kW three-phase power according as prescribed by the ISO. This existing power supply is used to power the cryogenic refrigeration system 14 which are available at points including on the transportation vehicle, on quay, at a storage facility, or the like. The plug 18 connects to the cryogenic refrigeration system 14 via a socket 20 that is accessible from the exterior of the shipping container. In this manner, the commonly available ISO power supply is used to power the cryogenic refrigeration system 14.

In one embodiment, if the superconducting magnet $\mathbf{12}_A$, $\mathbf{12}_B$ is to be transported on a flat-rack container, the cryogenic refrigeration system 14 can be strapped or mounted to one of the collapsible end walls then connected to the existing power supply 16. In this manner, the cryogenic refrigeration system 14 can then be removed and shipped back to the shipping origin.

In another embodiment, for transportation in standard or high cube intermodal containers, the end wall opposite the door end is modified to accommodate the cryogenic refrigeration system 14, i.e. the socket 20, ventilation, display, controls, or the like. The cryogenic refrigeration system 14 is non-removeably integrated into the end wall of the shipping container 10; therefore, the entire shipping container with the cryogenic refrigeration system 14 and other cargo in the now available space can be shipped to its origin. Alternatively, the cryogenic refrigeration system 14 is integrated into an intermodal container which includes doors at both ends. The doors at one end are modified to accommodate the socket 20, ventilation, display, controls, or the like. Upon arrival at a destination, the modified doors including the integrated cryogenic refrigeration system 14 are replaced with unmodified doors so the shipping container with two unmodified door ends can be reused. The modified doors including the cryogenic refrigeration system are then shipped back to their origin for reuse with another cryogenically cooled payload.

The cryogenic refrigeration system 14 serves to maintain a liquid or gaseous cryogen within the superconducting magnet $\mathbf{12}_A$, $\mathbf{12}_B$ during transit or storage. A refrigerant is circulated to a cold head $\mathbf{22}_A$, $\mathbf{22}_B$ of each superconducting magnet $\mathbf{12}_A$, $\mathbf{12}_B$ which maintains a temperature approximately that of or below the boiling point of the cryogen during transit. In one embodiment, a superconducting magnet may be shipped to a customer with a liquid cryogen installed. To eliminate and/or reduce the loss of the installed cryogen during transit, the cryogenic refrigeration system 14 circulates the refrigerant to the cold head $\mathbf{22}_A$, $\mathbf{22}_B$ to maintain superconducting temperatures in the superconducting coils. The refrigerant and/or installed cryogen may include helium, hydrogen, neon, nitrogen, or the like.

In one embodiment, each superconducting magnet $\mathbf{12}_A$, $\mathbf{12}_B$ is a cryogenically cooled superconducting magnet in which superconducting coils are partially bathed in a liquid cryogen bath and housed within a cryostat. The cold head $\mathbf{22}_A$, $\mathbf{22}_B$ projects into the cryostat and serves to re-condense any cryogen that may boil off in response to increases in temperature. Sensors housed within the cryostat, a control and monitoring unit, and/or cold head monitor the temperature and/or pressure of the cryostat. As the temperature rises and the liquid cryogen enters a gaseous state and the pressure within the cryostat increases. To relieve the increased pressure, an exhaust valve (not shown) releases the excess gas to maintain a pressure marginally above standard atmospheric conditions. For example, the pressure is maintained at approximately a half psi above standard atmospheric conditions to prevent negative pressure which may contaminate the cryogen. A negative pressure may allow external gases to leak inside of the cryostat.

In another embodiment, each superconducting magnet $12_A$, $12_B$ is a cryogen-free superconducting magnet in which the superconducting coils are thermally coupled to a heat exchanger. The heat exchanger is a cooling tube assembly in contact with the superconducting coils. The liquid cryogen is then circulated through the cooling tube assembly to cool the coils to approximately the boiling temperature of the circulated cryogen. A reservoir, which supplies the cooling tube assembly, is thermally coupled to the cold head $22_A$, $22_B$ to re-condense any gaseous cryogen. Similar to the cryogen cooled superconducting magnet, excess cryogen gas built up in the cooling tube assembly is vented through an exhaust valve. Alternatively, the heat exchanger is a solid thermal conductor thermally coupled to the superconducting coils. The solid thermal conductor may be constructed from a plurality of flexible copper straps which then coupled to the cold head $22_A$, $22_B$.

The cryogenic refrigeration system 14 monitors temperature and/or pressure sensors within the cold head $22_A$, $22_B$, the cryostat, and/or in proximity to the heat exchanger over a bi-directional data bus 24 and circulates the refrigerant to the cold head $22_A$, $22_B$ to cool or re-condense the cryogen within the cryostat or cooling tube assembly or to the sufficiently cool the solid thermal conductor. The cryogenic refrigeration system 14 also controls or actuates a state of valves $26_A$, $26_B$ to cycle the cryogenic refrigerant between more than one superconducting magnet $12_A$, $12_B$ being transported within a single shipping container 10. Accordingly, the cryogenic refrigeration system 14 can alternate cooling of multiple magnets to reduce power requirements by actuating the valves $26_A$, $26_B$ to one of an on state, off state, and a reduced flow state.

Figure 2:
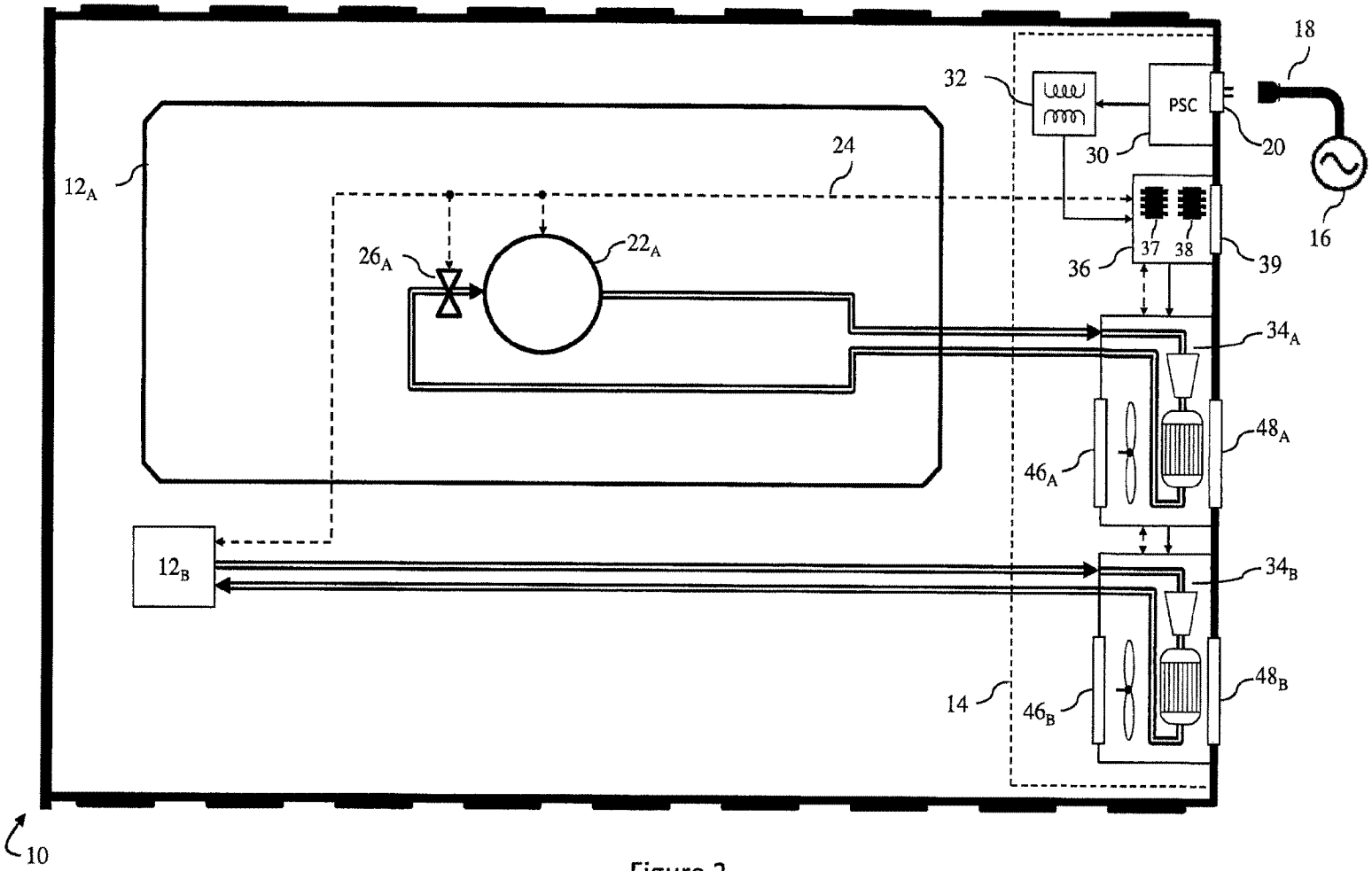
FIG. 2 is a schematic top-view of a cryogenic refrigeration system integrated into the shipping container.

FIG. 2 shows a diagrammatic view of the shipping container 10 and an exposed view of the cryogenic refrigeration system 14. The cryogenic refrigeration system 14 includes a power supply connection or inlet 30 which receives the power from the existing standard ISO power supply 18. A transformer 32 converts the input power to a voltage and/or phase useable by refrigeration units $34_A$, $34_B$, for example the transformer 32 converts the ISO standard 380 volts to the 460 volts used by condensers of the refrigeration units $34_A$, $34_B$. Additionally, the transformer may provide a useable voltage to the superconducting magnet to operate nominal systems. A control and monitoring unit (CMU) 36 controls the refrigeration units $34_A$, $34_B$, the valves $26_A$, $26_B$, and monitors the temperature and/or pressure sensors of each superconducting magnet over the data bus 24. A processor interprets a temperature and a pressure signal from the temperature and the pressure sensor, respectively. Instructions for controlling the refrigeration units $34_A$, $34_B$ based on these signals are stored on a computer-readable storage medium 37 to be executed by the processor 38. For example, the processor may execute a feedback control algorithm which adjusts a duty cycle for the refrigeration units $34_A$, $34_B$ based on the sensor signals and/or power consumption. Motion sensors, such as accelerometers and gyroscopes, can be used to monitor the motion and/or orientation of the shipping container 10, the magnets $12_A$, $12_B$, and/or the refrigeration system 14 during transit. The sensors can detect heavy turbulence and vibrations which can be used to signal the CMU 36 to temporarily suspend refrigeration of the cold heads $22_A$, $22_B$ to avoid possible damage therefrom.

The CMU 36 includes an externally accessible display unit 39 which displays data regarding the status of the cryogenic refrigeration system 14 parameters such as the operation of the refrigeration units $34_A$, $34_B$, the temperature and/or pressure of the superconducting magnets $12_A$, $12_B$, a state of the valves $26_A$, $26_B$, the refrigeration duty cycle, power consumption, or the like. Additionally, the display unit may include input controls by which a user may control and/or adjust the operating parameters. The data displayed on the display unit is driven by the processor 38.

Figure 3A:
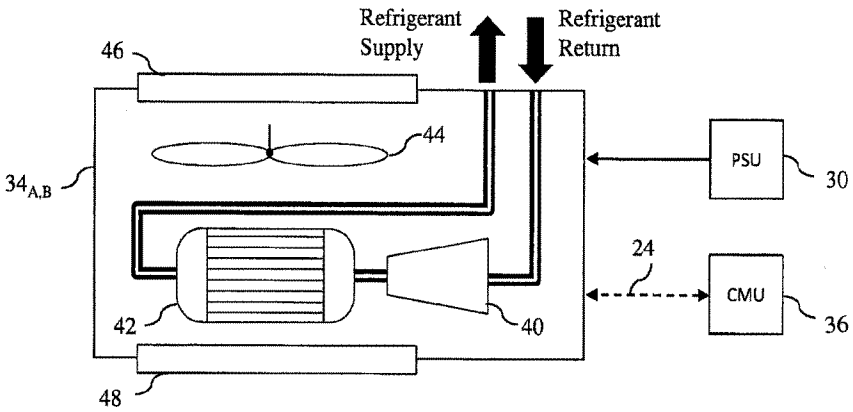
FIGS. 3A and 3B are schematic diagrams illustrating embodiments of condensing units housed within the cryogenic refrigeration system.
Figure 3B:
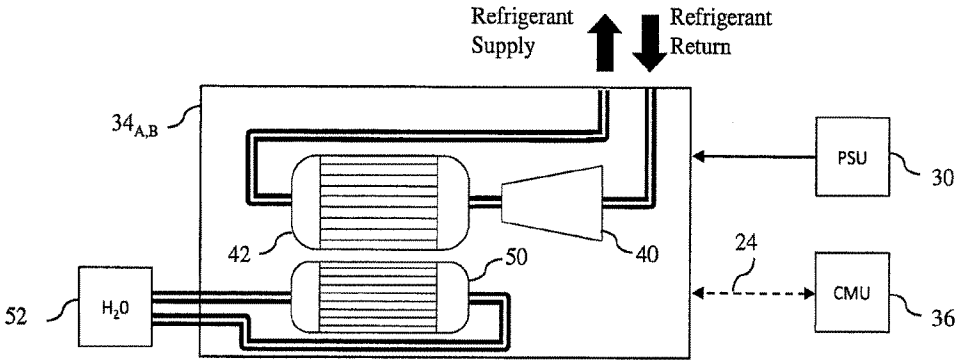

In the illustrated embodiment, two refrigeration units $34_A$, $34_B$ are shown supplying refrigerant to two corresponding superconducting magnets $12_A$, $12_B$. However, fewer or greater refrigerant compressors which supply corresponding superconducting magnets are also contemplated. Alternatively, a single refrigeration unit may supply more than one superconducting magnet. A multiplexed valve controlled by the CMU 36 can switch a supply line between multiple magnets. The arrangement and ratio of refrigeration units to superconducting magnets is dependent on the size, shape, and style of the shipping container and the size of the superconducting magnet and type of cryogen. The type of transportation vehicle may also be considered when determining the arrangement and number of refrigeration units 14. With reference to FIGS. 3A and 3B, the refrigeration units $34_A$, $34_B$ can be an air cooled unit as shown in FIG. 3A. The refrigerant gas is circulated into the refrigeration units via a return line. A compressor 40 increases the pressure of the refrigerant gas and feeds it into a condenser coil 42 which in turn removes heat from the refrigerant gas. The condenser coil 42 is cooled by a fan 44 which with pulls air from an intake vent or louver 46 across the condenser coil 42 and pushes the heated air through an exhaust vent or louver 48 to outside of the shipping container 10. The refrigerant is then re-circulated to the corresponding superconducting magnet $12_A$, $12_B$ via a refrigerant supply line.

Alternatively, the refrigeration units $34_A$, $34_B$ can be a water-cooled unit as shown in FIG. 3B. Instead of a fan and exhaust system to cool the condenser coil 42, a chilled water loop 50 removes the heat from the refrigerant gas to cool it. A chilled water supply 52 is typically supplied on shipping vessels for standard ISO refrigeration shipping containers where exhaustion of heated air is problematic. The refrigeration units $34_A$, $34_B$ can utilize the existing chilled water supply 52 to the cool the re-condensed refrigerant.

Figure 4A:
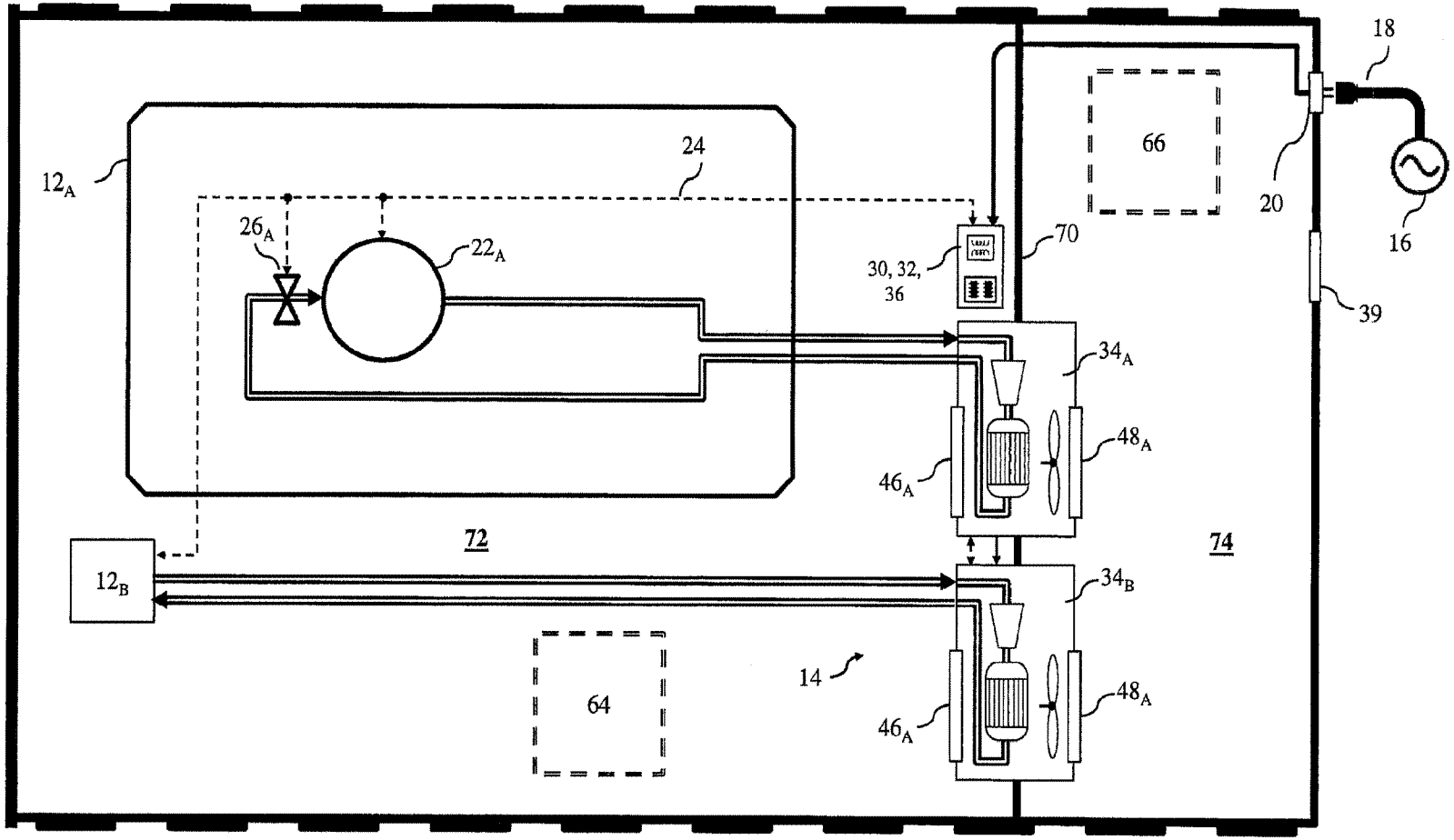
FIGS. 4A AND 4B are schematic diagrams of other embodiments of shipping containers for transporting and storing cryogenically cooled devices.
Figure 4B:
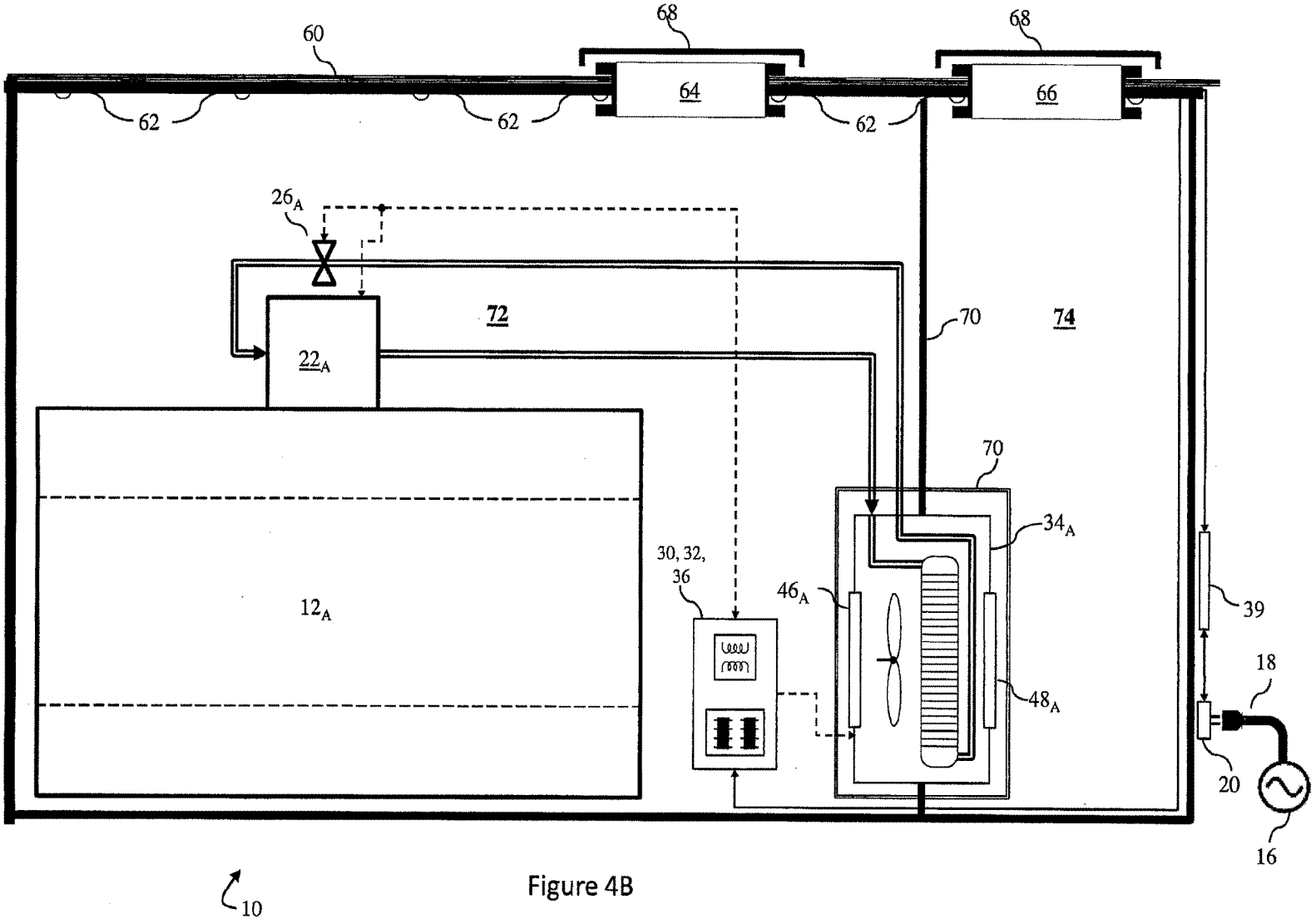

With reference to FIG. 4A, a top view, and FIG. 4B, a side view, in another embodiment for transportation in open-top shipping containers, the shipping container end walls are not modified to accommodate the refrigeration system 14 which includes one or more of the refrigeration units 34, the power inlet 30, the power transformer 32, and CMU 36. As previously mentioned, an open-top container includes corrugated steel walls and doors while the roof includes a removable tarpaulin 60 which is supported by a plurality of even spaced bows or cross members 62. The bows 62 not only support the tarpaulin 60 but also increase the structural integrity of the sidewalls and can be removed to allow the cargo, e.g. the superconducting magnets 12 and refrigeration system 14, can be loaded and unloaded from above.

In this embodiment, the refrigeration system 14 is fully contained within the container 10 unlike the flat-rack container embodiment or the standard shipping container embodiment where the heated air from the condenser coils 42 is exhausted outside the container. Therefore, exhaust air from the each refrigeration system 34 is discharged inside the shipping container which tends to raise the internal temperature of the shipping container. Such an increase of the internal temperature would increase the duty cycle of refrigeration system 14 leading to increased power demands and potential stress-related failures. Typically, the refrigeration unit includes a high temperature shut off which shuts off the refrigeration unit when the temperature exceeds a threshold, e.g., 60° C. An extended shut off or reduced duty cycle could lead to cryogen boil off.

To reduce the internal temperature of the shipping container 10, an intake vent/open 64 and exhaust vent 66 are fitted into the roof tarpaulin 60 of the open-top container 10. In this manner, only the tarpaulin 60 is modified with an opening for each vent, rather than one of the doors or an endwall of a standard container. Openings are cut into removable tarpaulin 60 and the corresponding vent 64, 66 are fixedly integrated into the tarpaulin. Each vent 64, 66 location is positioned such that ends of the vent are securely, yet removably, mounted to the bows 62 as shown in FIG. 4B. Each vent is covered by a hood 68 which permits the intake/exhaust air to flow freely while inhibiting debris, precipitation, or the like from entering the container 10.

To isolate the cooler intake air from the heated exhaust air, a partition 70 is positioned between the each refrigeration units' 34 intake vent 46 and exhaust vent 48 and the shipping containers intake vent 64 and exhaust vent 66 to form an intake plenum 72 and an exhaust plenum 74 as illustrated in the side-view of FIG. 4B. The cooler outside air is pulled into the intake plenum 72, which houses the superconducting magnet 12, with the vacuum pressure created by the cooling fans 44 of each refrigeration unit 34. The cooler air in the intake plenum 72 is pulled through the intake vent 46 by the cooling fan 44 and then pushed across each condenser coil 42 where it is heated. The fan 44 then pushes heated air through the exhaust vent 48 into the exhaust plenum 74 where the heated air exits the shipping container via the exhaust vent 66. The partition 70 inhibits the heated exhaust air from mixing with the cooler intake air which can in turn reduce the duty cycle of each refrigeration system 34. The partition in one embodiment is a tarpaulin.

The status display unit 39 is removably mounted to the exterior of the shipping container 10 to relay data regarding the status of the refrigeration system 14, the superconducting magnet 12, monitoring sensors, or the like to an operator. In the same manner, the power inlet 20 is also removably attached to the exterior of the shipping container such that the open-top container is not modified.

Once the shipping container 10 and its cryogenic payload 12 has reached its destination, the tarpaulin 60, the intake vent 64, the exhaust vent 66, the corresponding hoods 68, and the partition 70 are easily removed from the shipping container 10 and shipped back to its point of origin, e.g. the manufacturer. The manufacturer can then reuse the tarpaulin 60, the intake vent 64, the exhaust vent 66, the corresponding hoods 68, and the partition 70 in a different open-top shipping container with another cryogenic payload. In a similar fashion, the refrigeration system 14, which includes one or more refrigeration units 34, the power inlet 30, the power transformer 32, and the CMU 36, can be shipped back to its point of origin, e.g. the manufacturer, to be reused. The refrigeration system 14 can be packaged with or separate from the tarpaulin 60, the intake vent 64, exhaust vent 66, the corresponding hoods 68, and the partition 70. It should be appreciated that the refrigeration system and ventilation system can be shipped to various locations instead of their point of origin. For example, in situations where a cryogenic payload is to be transported from a location other than the manufacturer's location the packaged refrigeration and ventilation systems can be shipped together or separately to that location.

The described embodiments avoid the need of an onboard generator integrated into the shipping container which supplies power to the MRI or NMR systems existing cryogenic cooler. The generator and necessary fuel add weight to the shipping container which may not mitigate typical cryogen losses otherwise. Furthermore, the fuel and exhaust resulting from combustion pose a threat to the superconducting magnet and the transportation vehicle, e.g. air travel prohibits the use of a generator while in motion. By integrating or mounting a cryogenic refrigeration system 14 and using existing power supplied by the transportation vehicle, the weight of the shipping container is reduced to the superconducting magnet and the cryogenic refrigeration system. The other components of the MRI or NMR system, such as the cryogenic cooler, control system, patient bed, user interface, etc, can be shipping using alternate shipping methods which can further reduce costs.

In another embodiment, the superconducting magnet is shipped in the shipping container 10 with no liquid cryogen installed. After testing, the liquid cryogen is removed and any gaseous cryogen remains in either the cryostat or the heat exchanger. During transit, a dual phase cooling method is utilized in which re-condensed cryogen quickly boils off then re-condenses such that there is minimal liquid accumulation in the cryostat or heat exchanger. This method maintains an intermediate temperature which is substantially above the boiling temperature of the installed cryogen. For example, in a low temperature system which uses a liquid helium cryogen, the superconducting coils would be maintained at a temperature of approximately 40-50K. The cryogenic refrigeration system 14 operates in the same manner by supplying refrigerant to the cold head $\mathbf{22}_A$, $\mathbf{22}_B$ of each transported superconducting magnet $\mathbf{12}_A$, $\mathbf{12}_B$. However, the duty cycle to maintain a temperature of 40-50K using the dual phase cooling method is less which results in a lower power requirement. The specific heat required to cool the superconducting coils from 40-50K to 4.2K is much less than cooling a magnet from room temperature. If the magnet is transported or stored for long periods of time the cost to maintain the magnet at 40-50K and then cool the magnet to operating temperature may be significantly less than the costs to either maintain the magnet at operating temperature or cool the magnet from room temperature.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

The invention claimed is:

1. A method of shipping a cryo-cooled device, the method comprising:

installing a cryogenic refrigeration system in an intermodal shipping container at a first location;

securing the cryo-cooled device in the intermodal shipping container;

connecting the cryo-cooled device with the cryogenic refrigeration system;

loading the intermodal shipping container on a transport vehicle;

connecting the cryogenic refrigeration system with a power supply of the transport vehicle;

powering the cryogenic refrigeration system to circulate cryogen between the cryogenic refrigeration system and the cryo-cooled device;

transporting the intermodal shipping container with the transport vehicle to a destination;

disconnecting the cryogenic refrigeration system from the power supply of the transportation vehicle;

unloading the intermodal shipping container from the transportation vehicle;

unloading the cryo-cooled device from the intermodal shipping container;

removing the cryogenic refrigeration system from the shipping container; and transporting the cryogenic refrigeration system separate from the intermodal shipping container back to the first location.

2. The method according to claim 1, further including:

installing a vent in the intermodal shipping container;

during the transporting of the intermodal shipping container, venting hot air generated by the cryogenic refrigeration system through the vent.

3. The method according to claim 2, further including:

installing an electrical connection to an exterior of the shipping container;

electrically connecting the electrical connection to the cryogenic refrigeration system; and connecting the power supply of the transport vehicle to the electrical connection.

4. The method according to claim 3, further including:

mounting a transformer in the shipping container; and with the transformer, converting the electrical power received from the transport vehicle to match operating electrical voltage requirements of the cryogenic refrigeration system.

5. The method according to claim 3, wherein the cryogenic refrigeration system, the vent, and the electrical connection are mounted with a door of the intermodal shipping container and wherein shipping the cryogenic refrigeration system to the first location includes shipping the door with the cryogenic refrigeration system, the electrical connection, and the vent mounted to the door as a unit back to the first location.

6. The method according to claim 1, wherein the shipping container is a top-loading shipping container and further including:

mounting an intake vent and an exhaust vent in a top of the shipping container;

disposing a removable partition within the shipping container between the inlet vent and the exhaust vent to form an intake plenum which receives outside air from the inlet vent and an exhaust plenum which carries air heated by the cryogenic refrigeration system to the exhaust vent.

7. The method according to claim 6, wherein the top of the shipping container includes a tarpaulin.

8. The method according to claim 7, further including:

shipping the tarpaulin and the removable partition back to the first location with the cryogenic refrigeration system.

9. The method according to claim 1, further including:

mounting a display device to an exterior of the intermodal shipping container, the display device being connected with a control processor;

with the control processor, controlling operating parameters of the cryogenic refrigeration system and controlling the display device to display at least refrigeration duty cycle and power consumption information about the cryogenic refrigeration device.

10. The method according to claim 1, wherein the cryo-cooled device is a superconducting magnet, a cold head of the superconducting magnet being connected to the cryogenic refrigeration unit.

11. The method according to claim 10, further including:

prior to securing the superconducting magnet in the shipping container, installing a liquid cryogen in the superconducting magnet;

during the transporting, monitoring a temperature and/or pressure of the installed liquid cryogen; and during the transporting, circulating a cryogenic refrigerant from the cryogenic refrigeration system to the cold head based on the monitored temperature and/or pressure to maintain a selected temperature and/or pressure.

12. The method according to claim 10, further including:

prior to securing the superconducting magnet, removing liquid cryogen previously installed in the superconducting magnet while preserving any gaseous cryogen;

during the transporting, monitoring the temperature and/or pressure of the gaseous cryogen;

during the transporting, circulating a cryogenic refrigerant from the cryogenic refrigeration system to the cold head based on the monitored temperature and/or pressure to maintain a preselected temperature and/or pressure.

13. The method according to claim 10, further including:

securing a second superconducting magnet in the shipping container;

connecting tubing to both superconducting magnets and the cryogenic refrigeration system;

installing an electronically controllable valve in the tubing;

during the transporting, with a control processor, controlling the electronically controllable valve to adjust a duty cycle with which the cryogen is circulated to each of the superconducting magnets.

14. The method according to claim 1, wherein transporting the container includes transporting the container on a container ship.

15. The method according to claim 14, wherein the cryo-cooled device includes a superconducting magnet.

16. The method according to claim 15, further including removably mounting:

an electrical connector to an exterior of the shipping container, the electrical connector being electrically connected with the cryogenic refrigeration system, the electrical connector being configured for interconnection with the power supply of the transport vehicle;

an inlet vent and an outlet vent mounted in a wall of the shipping container;

a removable partition in the shipping container to divide the shipping container into an inlet plenum through which outside air travels to the cryogenic refrigeration system and an outlet plenum through which hot air from the cryogenic refrigeration system flows to the outlet vent;

a display device on an exterior of the shipping container;

a control processor configured to control the cryogenic refrigeration system to control a temperature and/or pressure of a cryogen in a superconducting magnet in the shipping container and to control the display device to display data regarding parameters of the cryogenic refrigeration system.

* * * * *